United States Patent [19]

Guest et al.

[11] Patent Number: 4,990,892

[45] Date of Patent: Feb. 5, 1991

[54] PERSONNEL LOCATOR SYSTEM

[75] Inventors: Barnie L. Guest, Jacksonville, Fla.; Leslie C. Laney, Jackson, Miss.; Dennis K. Fredrickson, Jacksonville, Fla.

[73] Assignee: Westcom, a division of Westside Communications of Jacksonville, Inc., Jacksonville, Fla.

[21] Appl. No.: 396,895

[22] Filed: Aug. 7, 1989

[51] Int. Cl.[5] ..... G08B 23/00; G08B 5/22

[52] U.S. Cl. ..... 340/573; 340/825.49; 455/618

[58] Field of Search ..... 340/573, 825.49, 825.63, 340/825.69; 455/618–619; 370/32

[56] References Cited

U.S. PATENT DOCUMENTS

| | | | |
|---|---|---|---|
| 3,972,320 | 8/1976 | Kalman | 340/573 X |
| 4,644,524 | 2/1987 | Emery | 370/32 X |
| 4,769,643 | 9/1988 | Sogame | 340/825.69 |

*Primary Examiner*—Glen R. Swann, III

*Assistant Examiner*—Thomas J. Mullen, Jr.

*Attorney, Agent, or Firm*—Clifford A. Poff

[57] ABSTRACT

A personnel locator system for monitoring the locations of classes of personnel. Members of classes of personnel carry portable, infrared transmitters which transmit pulse trains during discrete burst periods. Transmitters carried by members of different classes of personnel transmit pulse trains of different, predetermined frequencies to identify the classes, and transmit the pulse trains during distinct burst periods to prevent phase synchronization between pulse trains transmitted by the different transmitters. Infrared receivers are positioned to receive the transmitted pulse trains in order to monitor the continued presence locations of the members of the classes of personnel. The system utilizes pulse trains having pulses of short pulse widths during a relatively long time period in order to allow increased battery life while transmitting at high energy levels to saturate the area of reception. The pulses are of less than 40 microseconds during a 55 millisecond time frame.

32 Claims, 4 Drawing Sheets

PERSONNEL LOCATOR SYSTEM

BACKGROUND OF THE INVENTION

1. Field of the Invention:

The present invention relates generally to electronic locating and annunciating systems, and, more particularly, to a continuous locating and annunciating system for maintaining a registry of the locations of classes of personnel and for annunciating their locations.

2. Description of the Prior Art:

The need to maintain an up-to-date registry of personnel in a building or facility is oftentimes required to allow efficient operation of a facility. In some situations, such as a hospital setting, for example, the ability to quickly locate operating personnel can, at times, be of critical importance. As a result, many systems have been developed in order to monitor the location of personnel, or, at least to make annunciations in order to allow personnel to respond to such.

One of the simplest methods of locating personnel within a facility involves merely installing a network of loudspeakers, or the like, spaced throughout the facility. When personnel are to be located, an announcement is broadcast over the loudspeakers. The personnel can then respond to the announcement. Such systems suffer from the inherent disadvantage that the personnel must both hear the broadcast announcement, and make some active response thereto. Additionally, the broadcast announcement distracts all personnel within hearing distance of the loudspeakers, and not just those personnel who are to be located. Furthermore, through such a method, maintaining an up-to-date registry system for monitoring the location of personnel is impractical.

As a result, more elaborate systems have been developed in the prior art for monitoring the locations of personnel in a facility. Ideally, the system is non-intrusive, and does not require the active response of personnel.

Disclosed in U.S. Pat. Nos. 3,439,320; 3,696,384; and 3,739,329 are personnel monitoring systems which utilize portable transceivers carried by the personnel. The transceivers transmit ultrasonic frequency waves. The systems operate using a "scan/respond" format in which the portable transceivers transmit signals responsive to reception of a "scan" signal generated by a remote transmitter. Because the transceiver is operative only when the transceiver is "scanned", power consumption of the transceiver is minimized. Several problems are inherent, however, in ultrasonic scan/respond systems. First, if the personnel carrying the transceiver travels beyond the range of the scan signal, the transceiver does not transmit a signal in response, and an erroneous registry indication results. In order to minimize this problem, the systems are designed in order to function at maximum transmission ranges. To allow functioning in this range, the transceivers must be designed to operate at high energy levels, resulting in excessive battery drain.

Operation of the systems at high transmission energies results in additional problems. When an ultrasonic signal is transmitted at a high energy level, the ultrasonic frequency signal may be transmitted through a boundary, such as a wall, resulting, again, in erroneous indications of the location of personnel. In fact, when transmitting at the high energy levels, the registry systems may indicate that one person is in several locations at the same time.

Prior art systems have been developed utilizing infrared frequency transmitter/receivers. For example, disclosed in German patent number 3210002 is a system in which infrared light emitters transmit periodic signals whose detection by an infrared receiver energizes relays to register the presence of a person carrying the infrared emitters. No means, however, is disclosed for preventing signal overlap between two different periodic signals transmitted by emitters carried by two different individuals. Additionally, the infrared emitters transmit the periodic signals constantly, which degrades battery longevity.

Also, disclosed in U.S. Pat. No. 4,275,385 is a personnel locating system which maintains a registry of individuals by tracking their entry and exit from defined areas. Each person carries a portable transmitter, and each transmitter transmits a unique sixteen bit binary codeword with start, stop and parity bits employing infrared light emitting diodes. Infrared receivers are positioned to allow detection of the binary codeword transmitted by the transmitter. However, the receiver can only detect the transmitted codeword over a limited range, and only when the receiver is positioned so as to be in the "line of sight" of the transmitter. To overcome this problem, the receivers are positioned in doorways to rooms forming the defined area. When a person carrying a transmitter passes through the doorway, such passage is detected. The system therefore actually tracks the entrance and exit of personnel from the rooms rather than continuously maintaining the locations of the personnel. As a result, this prior art system also suffers from several inherent disadvantages. First, because a receiver only detects the transmitted signal during the brief period of time in which personnel pass through a doorway, any transmission problem occurring during this period of time results in the entry and/or exit of the personnel not to be registered. Because a unique multi-bit codeword, as well as parity and stop/start bits must be transmitted in sequence by a portable transmitter in order to correctly identify the personnel passing through the doorway, any bit error results in an incorrect registry entry. Additionally, the number of receivers required to maintain an accurate registry of personnel increases greatly if a room contains more than one doorway allowing entrance and exit. A still further disadvantage inherent to this system occurs when two or more individuals enter through a doorway simultaneously either in close proximity to one another (i.e., within the envelope of the receiver). The receiver cannot differentiate between the transmitted signals as the start bits transmitted by each transmitter prevents the receiver from detecting the presence of any transmitter. Again, an erroneous registry indication results as no individual is registered as entering and/or exiting through the doorway. Still further, an erroneous registry indication also results when personnel pass within the envelope of the receiver, but do not pass through the doorway. For example, in a hospital setting, personnel walking along a hallway may pass within the envelope of several receivers positioned in the doorways of several rooms, but enter none of the rooms. The system would register such personnel in all of the rooms at the same time. In a hospital setting, such false information is actually more detrimental than no information at all.

As mentioned hereinabove, a locating system allowing quick location of operating personnel is oftentimes of critical importance in a hospital setting. Broadcasting announcements over loudspeakers is, of course, impractical in a hospital setting, and other prior art systems for creating and maintaining an up-to-date registry system of hospital personnel suffer from disadvantages, as mentioned hereinabove.

In a hospital setting, an up-to-date registry is also needed in order to create and maintain a historical record of the locations of members of classes of personnel. Accurate records of the locations of classes of personnel must also be maintained for future reference, such as, for example, in the event of subsequent litigation. No prior art registry system is known which tracks the locations of classes of personnel directly. Prior art systems, such as the one disclosed in U.S. Pat. No. 4,275,385 track the locations of individuals. And as mentioned hereinabove, several inherent disadvantages are associated with this system, thereby limiting its usefulness.

It is, accordingly, an object of the present invention to provide a personnel locator system for locating personnel in a facility.

It is a further object of the present invention to provide a personnel locating system which detects the presence and the continued presence of personnel.

It is a yet further object of the present invention to provide an infrared personnel locator system which overcomes the disadvantages associated with prior art infrared systems.

It is a still further object of the present invention to provide a personnel locating and monitoring system for maintaining a registry of locations of classes of personnel in a hospital setting.

SUMMARY OF THE INVENTION

According to the present invention, a personnel locator system installable on a premises comprising at least one portable communication unit adapted to be carried by an individual and monitored at appropriate locations about the premises is disclosed.

The personnel locator system includes a means for generating pulses defining a pulse train, wherein the pulses occur at predetermined frequencies. The system also includes a means for determining discrete time intervals defining burst periods, wherein groups of the burst periods define a burst spectrum. A means for transmitting the pulse train generated by the means for generating pulses during selected ones of the burst periods is included, and a means responsive to the pulse train transmitted during the selected ones of the burst periods for identifying the portable communication unit and the location thereof is also included.

The means for generating pulses may include a multivibrator means for generating a pulse train having square wave pulses occurring at the predetermined frequency, and may further include a pulse shaping means coupled to receive the pulse train generated by the multivibrator means for shaping the pulses of the pulse train into pulses having precisely defined pulse widths.

In the preferred embodiment of the present invention, the means for determining the time intervals defining burst periods defines ten bursts period per burst spectrum In this preferred embodiment, the means for transmitting transmits the pulse train for two burst periods during each burst spectrum.

The means for transmitting preferably includes infrared emitters, and a means for powering the infrared emitters comprised of a battery connected in parallel with a capacitor. The battery generates a current for charging the capacitor, and discharge of the capacitor powers the infrared light emitters such that the infrared light emitters operate at high intensity levels during the discharge. In this embodiment, the means responsive to the pulse train includes infrared detectors for detecting infrared emitted by the infrared emitters, and the means responsive to the pulse train generates a signal in response to those times in which transmission of a pulse train is detected.

The system of the present invention preferably further includes a central recording means coupled to receive the signal generated by the means responsive to the pulse train for recording those times in which the pulse train is detected, an annunciating means coupled to receive the signal for annunciating those times in which the pulse train is detected, and a control means coupled to receive the signal for providing control functions responsive to those times in which transmission of the pulse train is detected.

In the fullest embodiment of the present invention, the system includes a plurality of portable communication units wherein the plurality of portable communication units are grouped into classes, with the classes being defined by the predetermined frequencies of the pulse train generated by the means for generating pulses of each of the plurality of portable communication units. In this embodiment, the means for transmitting of each portable communication unit transmits the pulse train for two burst periods during each burst spectrum, wherein the burst periods are selected such that the communication units of different ones of the classes transmit the pulse trains for non-identical burst periods.

In the preferred embodiment of the present invention, the means responsive to the pulse trains includes a plurality of discrete receivers, each of the discrete receivers defining a separate defined reception range about a premises, wherein reception of the pulse train by a receiver indicates the presence of a portable communication unit within the location defined by the reception range thereof, and wherein the predetermined frequency of the pulse train identifies the portable communication unit.

The system of the present invention is ideally utilized as a registry system for maintaining a registry of the locations of defined classes of personnel. The registry system includes a plurality of portable transmitters carried by the members of each of the defined classes of personnel, wherein each of the plurality of portable transmitters includes a means for generating a pulse train of a desired frequency, and a transmitting means coupled thereto for transmitting the pulse train during discrete burst periods over a transmission channel. The frequencies defining the pulse train of individual ones of the portable transmitters have values allowing differentiation between the classes of personnel. A receiving means, comprised of a plurality of spaced-apart discrete receivers wherein each of the discrete receivers has a defined reception range, receives from the transmission channel the pulse train generated by the portable transmitters A control means is coupled to the receiving means for recording those times in which a particular discrete receiver receives a pulse train generated by a portable transmitter to thereby register the location of a member of a class of personnel.

Each of the portable transmitters preferably includes infrared emitters for emitting infrared. The emitters are turned on and off responsive to the frequency of the pulse train. The spaced-apart discrete receivers comprising the receiving means includes infrared detectors for detecting the pulse train transmitted by the portable transmitters. In order to increase the intensity level of the infrared emitters, each of the portable transmitters preferably further includes a power means comprised of a battery means connected in parallel with a capacitor means. The capacitor means builds-up charge to thereafter discharge in discrete bursts, such discharge allowing the infrared light emitters to emit infrared light at an increased energy level. By increasing the energy level of the infrared emitters, the energy of the infrared light saturates the area of reception of the spaced apart, discrete receivers.

The system of the present invention allows each transmitter to be constantly monitored and allows simultaneous detection of more than one transmitter by a single receiver. The portable transmitters, one of which is carried by each member of the operating personnel, are each powered by a portable battery and transmit periodic signals which are detected by a plurality of infrared receivers. The infrared receivers may each be mounted in an area to be monitored by the system of the present invention. The portable transmitter may be, for example, attached to the blouse or shirt of an individual as part of a name badge. By transmitting the pulse train of a frequency associated with a class of personnel, a registry of the locations of a class member of a class of personnel may be created and maintained. By transmitting the pulse train in the form of very short, high energy infrared bursts, the intensity level of the infrared transmission is increased, while at the same time, preventing excessive battery drain.

When an individual of a class of personnel who is wearing a portable transmitter enters anywhere within the reception range of a receiver, the pulse train transmitted by the transmitter within such area is constantly monitored. Each receiver may further provide a visual confirmation of detection of the transmitted indicating signal, such as by the addition of light emitting diodes to indicate such detection, and outputs for connection to other systems or a control unit.

The registry of the present invention, by requiring the portable transmitter to transmit the pulse train in order for the presence of the portable transmitter to be recorded, ensures that the prior art problem associated with false indications of the presence of personnel in an area due to entry/exit-only recording is precluded. Additionally, synchronization between simultaneously transmitted signals by more than one transmitter resulting in erroneous indications is precluded.

BRIEF DESCRIPTION OF THE DRAWINGS

The present invention will be better understood when read in light of the accompanying drawings in which.

DETAILED DESCRIPTION OF THE PREFERRED EMBODIMENTS

Figure 1:
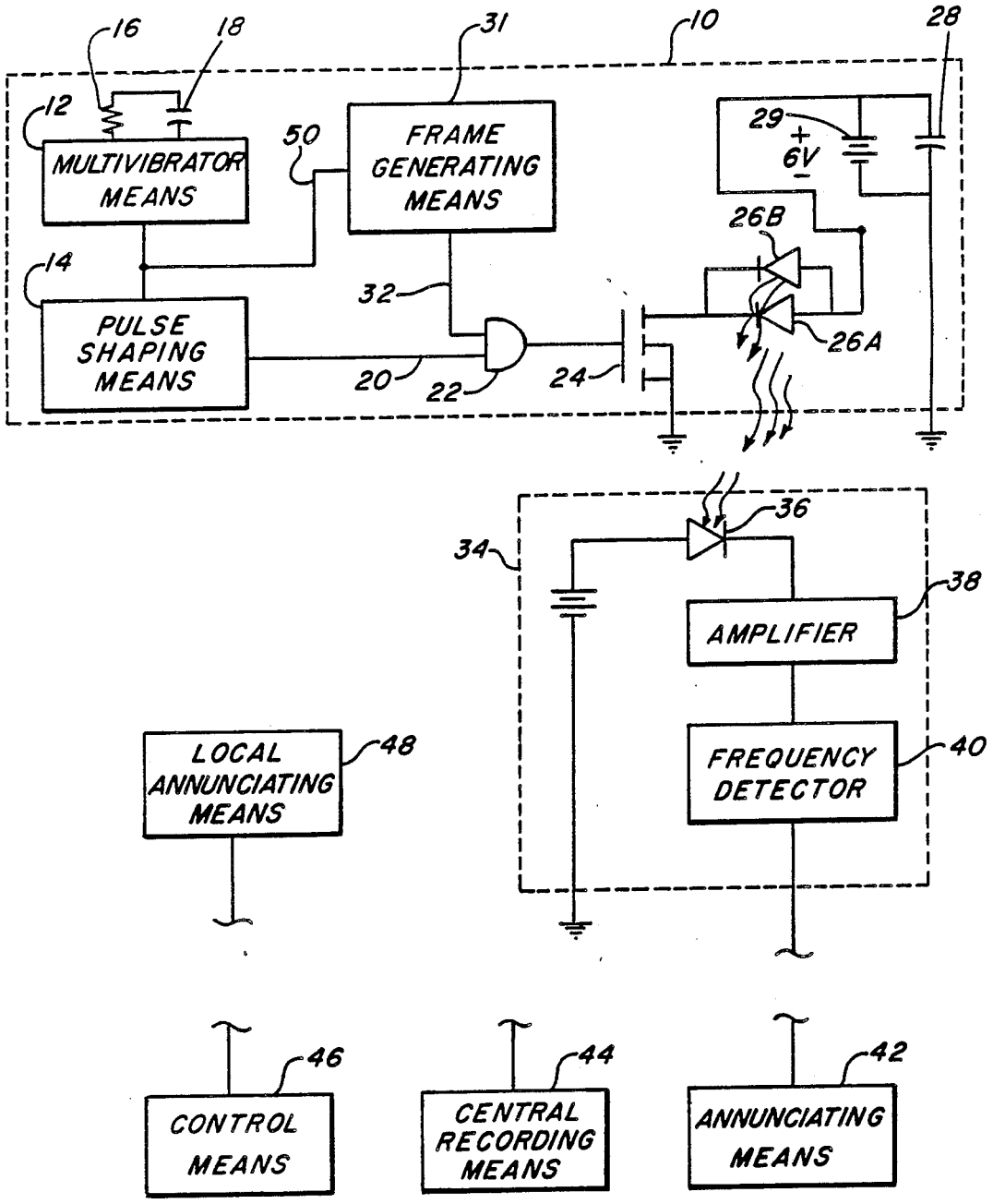
FIG. 1 is a block diagram of a transmitter/receiver combination of the present invention.

Referring first now to the block diagram of FIG. 1, there is illustrated, in block form, the communication unit for forming the personnel locator system of the present invention. The communication unit includes a portable transmitter, referred to generally by reference numeral 10. In the preferred embodiment of the present invention, the personnel locator system of the present invention includes numerous transmitters 10. In general, each portable transmitter 10 transmits a periodic pulse train in discrete bursts wherein the frequency of the pulse train identifies the transmitter, and the bursts of time in which the pulse train is transmitted are selected in order to prevent overlapping of signals during simultaneous operation of more than one transmitter 10. Each transmitter 10 is preferably constructed of a printed circuit board utilizing surface mount technology.

As illustrated in the block diagram of FIG. 1, portable transmitter 10 includes multivibrator means 12 for generating a pulse train of a desired frequency, and a pulse shaping means 14 coupled to receive the pulse train generated by the multivibrator means 12. Pulse shaping means 14 shapes the pulse train generated by multivibrator means into a modified pulse train having pulses of precisely defined pulse widths. Pulse shaping means 14 preferably shapes the pulses of the pulse train into pulses having widths of five microseconds. A five microsecond pulse width is an important engineering parameter in order to ensure that commercially available integrated circuits can be utilized in the circuit design. For reasons which will become more readily apparent hereinbelow, an important design criteria is the minimization of the pulse width. Multivibrator means 12 can be easily constructed with commercially available components wherein the frequency of the generated pulse train is determined by the selection of a resistor-capacitor pair 16-18.

Figure 2:
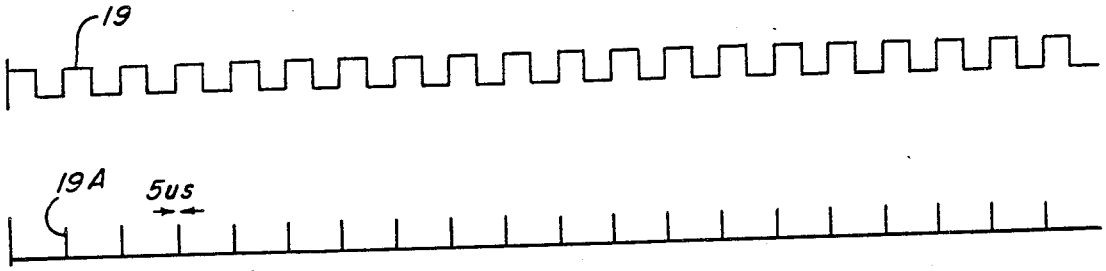
FIG. 2 is a graphical representation of the relationship between the pulse train generated by the multivibrator means of a transmitter, and the modified pulse train generated by the pulse shaping means of the transmitter.

The timing diagram of FIG. 2 illustrates the interrelationship between the pulse train signal generated by multivibrator means 12, and the modified pulse train generated by pulse shaping means 14. The diagram illustrates the relationship between these pulsed signals for a single R-C combination 16-18. Pulse train 19 is a monopolar periodic signal output by multivibrator means 12. In a preferred embodiment of the present invention, the leading edge of the positive sides of the pulses of waveform 19 trigger the pulse shaping means 14 to modify the pulses of the pulse train into the pulse train 19A.

Referring now again to FIG. 1, the modified pulse train generated by pulse shaping means 14 is transmitted on line 20 and is supplied to a first input of gate 22. The output of gate 22 is connected to the gate-side of a field effect transistor which comprises switch means 24. Negative sides of infrared emitting diodes 26A and 26B are coupled to the source of the field effect transistor switch 24. The positive sides of diodes 26A and 26B are coupled to capacitor 28 and voltage supply 29, here shown to be a six volt dc supply. During those instances in which the output of gate 22 causes switch 24 to close, the circuit loop including infrared emitting diodes 26A and 26B closes, thereby forward biasing the diodes, and causing the diodes 26 to transmit.

It is an important and novel feature of the present invention that by significantly increasing the intensity of the infrared transmitted by the diodes 26A and 26B, the increased dispersion of the higher intensity infrared saturates an area with infrared. By saturating an area with infrared, the range of detection of transmitted energy by a receiver is greatly increased. Connecting capacitor 28 and battery 29 in a parallel connection allows the diodes 26A and 26B to be operated at the high intensity levels.

Figure 3:
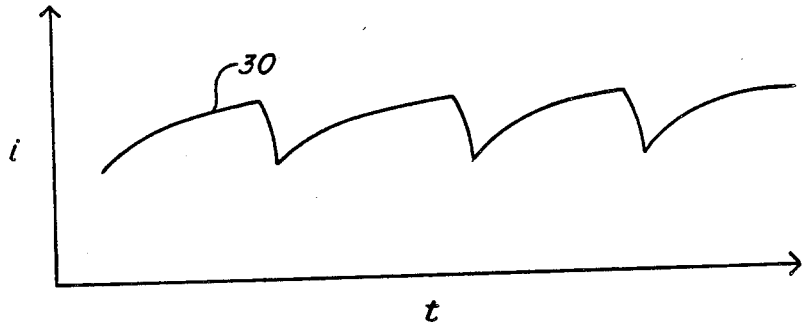
FIG. 3 is a graphical representation of the charging pattern of the capacitor utilized to allow the transmitter forming a portion of the present invention to transmit at high intensity levels.

Referring now to the graph of FIG. 3, there is shown the charging curve 30 of capacitor 28. Battery 29 is preferably selected to be a low-power, lithium-manganese dioxide battery having voltage and current characteristics below the threshold level of the diodes, such as a DURACELL (TM) D12430 battery. Because of the parallel connection with capacitor 28, however, battery 29 charges capacitor 28. Charging of capacitor 28 is illustrated by the rising portions of the characteristic curve 30. The sharply falling portions of the curve 30 illustrate the discharge of the capacitor. The current caused by the capacitive discharge allows diodes 26A and 26B to operate at high intensity levels when switch 24 is closed, forming a closed-circuit loop.

Such a method of powering the diodes 26A and 26B is advantageous for two reasons. Not only are diodes operated at high intensity levels, but because the diodes are powered by capacitive discharge intermittently, rather than directly by the battery, excessive battery drain is avoided.

Referring again to FIG. 1, also coupled to receive the pulse train generated by multivibrator means 12 is frame generating means 31. Frame generating means 31 generates a signal on line 32 which is supplied to a second input of gate 22. Because the output of gate 22 controls operation of switch 24, and because the output of frame generating means 31 is supplied to an input of gate 22, the output of the frame generating means enables the closing of the switch, or prevents closing of the switch. Frame generating means 31 thereby functions to determine the bursts of time in which the pulse train identifying the transmitter 10 is transmitted.

Also illustrated in the block diagram of FIG. 1 is a receiver, referred to generally by reference numeral 34, for receiving the infrared light transmitted by LEDs 26A and 26B of transmitter 10. When the LEDs 26 of a portable transmitter 10 are caused to emit infrared infrared within the detection range of detector 36, here preferably an infrared photodetector, detector 36 generates a signal responsive thereto. The signal generated by detector 36 is amplified by amplifier 38, and an amplified signal is supplied to frequency detector 40. Frequency detector 40 determines the frequency of occurrence of the infrared pulses detected by infrared detector 36, and a signal indicative of this determination can be supplied to any of many remote devices. For example, the receiver 34 may be coupled to annunciating means 42 to annunciate those times in which receiver 34 detects a signal transmitted by transmitter 10. Central recording means 44 may be coupled to receiver 34 to record such detections. And control means 46 may be coupled to receiver 34 to perform some function responsive to such detection, such as providing a signal to local annunciating means 48.

Figure 4:
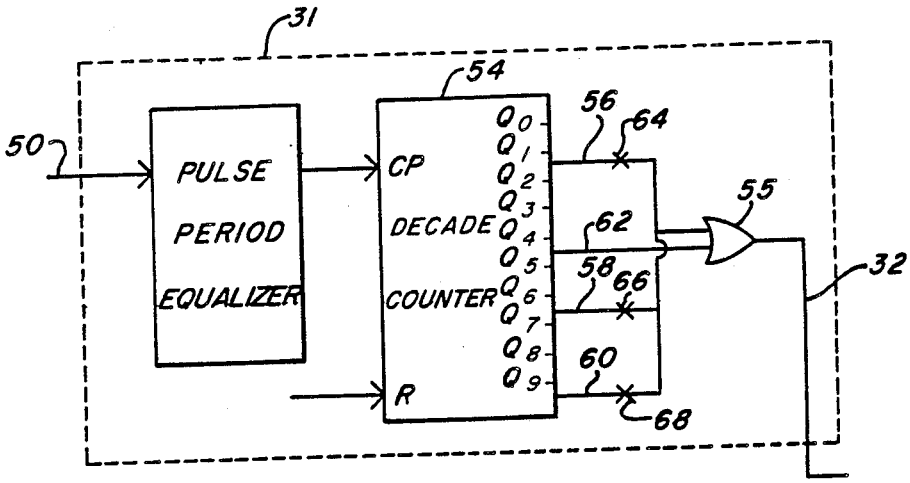
FIG. 4 illustrates a block diagram of the frame generating means of the transmitter of the present invention.

Referring now to the block diagram of FIG. 4, there is illustrated a more detailed representation of the frame generating means 31 of the portable transmitter 10 of the present invention. The pulse train generated by multivibrator means 12 is input to frame generating means 31 on line 50. Line 50 is coupled to pulse period equalizer 52 of frame generating means 31. Pulse period equalizer 52 generates an output pulse train on line 53 of a predetermined periodicity. The frequency of the pulse train generated by pulse period equalizer 52 is proportional to the frequency of the pulse train generated by multivibrator means 12, and the pulse trains output by the pulse period equalizers 53 of all like transmitters 10 are of the same frequency. Because multivibrator means 12 of different transmitters 10 having resistor-capacitor combination 16-18 of differing values generate pulse trains of different frequencies, pulse period equalizer 52 is designed for a particular transmitter 10 having a particular R-C combination 16-18. In the preferred embodiment of the present invention, the pulse train output on line 53 has a period of 55 milliseconds. By selecting the R-C combination 16-18 on various transmitters 10 such that the pulse train generated by multivibrator means 12 of the respective transmitters 10 are multiples of one another, pulse period equalizer 52 may be comprised of a commercially available binary counter having outputs which are multiples of one another.

Line 53 is coupled to a clock input of a decade counter 54. Decade counter 54 increments each time in which a pulse of the pulse train output on line 53 is supplied to the clock pulse input of decade counter 54. In the preferred embodiment of FIG. 4, when a first R-C combination 16-18 is selected, a first output of the decade counter 54 is supplied to gate 55 on line 56. When a second R-C combination 16-18 is selected, a second output of decade counter 54 is supplied to gate 55 on line 58. When a third R-C combination 16-18 is selected, a third output of decade counter 54 is supplied to gate 55 on line 60. Lines 56, 58 and 60 are alternately supplied to gate 55 by appropriate jumpering of jumpers 64, 66, or 68, respectively. Additionally, a fourth output of decade counter 54 is supplied to a second input of gate 55 on line 62. The output of gate 55 is coupled to gate 22 through line 32 as illustrated in FIG. 1. For purposes of illustration, line 62 connects output Q4 of decade counter 54 to gate 55, line 56 connects output Q1 of decade counter 54 to gate 55, line 58 connects output Q6 of decade counter 54 to gate 55, and line 60 connects output Q9 of decade counter 54.

Figure 5:
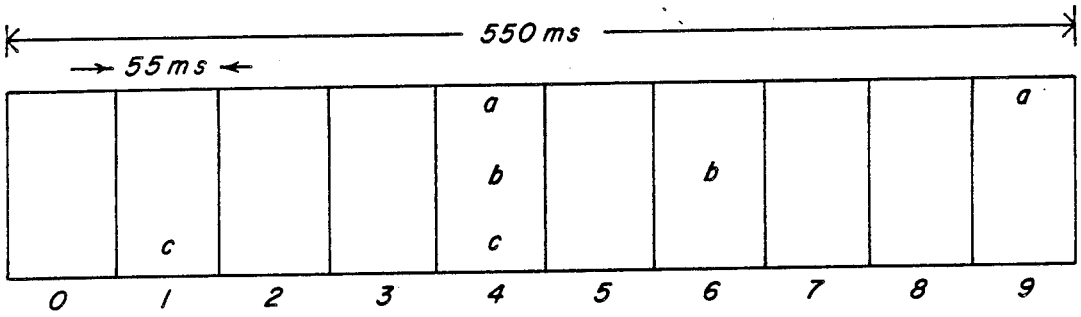
FIG. 5 illustrates the burst periods during which the frame generating means of three different transmitters output a signal to prevent phase synchronization between signals of the three transmitters during their simultaneous operation.

Turning now to FIG. 5, there is shown the time relationship between three transmitters 10 having three different R-C combinations 16-18, and the time relationship between the signals output by frame generating means 31 of three transmitters 10 to prevent overlapping of signals during simultaneous operation of all three transmitters. As noted previously, the pulse train generated by the pulse period equalizer 52 of any of the transmitters 10, in the preferred embodiment, has a period of 55 milliseconds. Each 55 millisecond pulse defines a burst period, and ten burst periods, corresponding to the ten outputs of decade counter 54, are illustrated in FIG. 5. Ten burst periods define a burst spectrum of 550 milliseconds. In FIG. 5, first transmitter 10 is referred to by 'a' second transmitter 10 is referred to by 'b', and third transmitter 10 is referred to by 'c'.

The burst periods during which line 32 passes a signal are selected such that the two burst periods that each transmitter 10 is allowed to transmit during a single burst spectrum can not be identical. When the outputs of decade counter 54 are connected to gate 55 as illustrated in FIG. 4, transmitter 'a' transmits during burst periods 4 and 9, transmitter 'b' transmits during burst periods 4 and 6, and transmitter 'c' transmits during burst periods 1 and 4. Even when numerous transmitters 10 are operated simultaneously, but are out of phase with one another, the burst periods during which transmitters 10 are permitted to transmit do not overlap.

Figure 6:
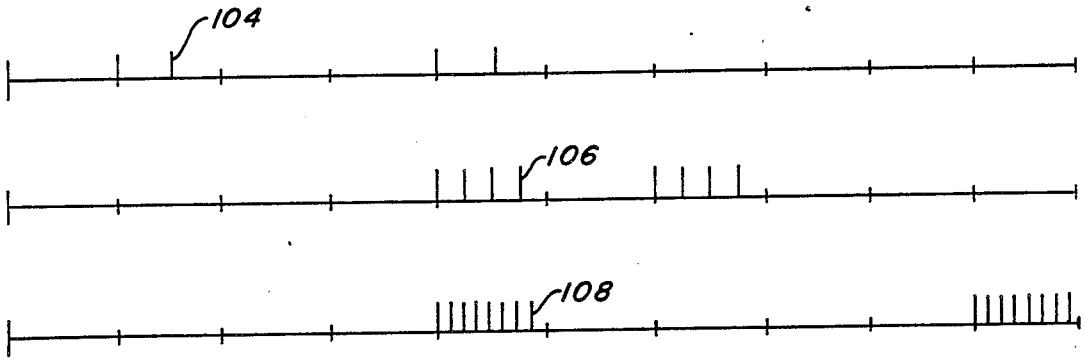
FIG. 6 is a graphical representation of the pulse trains generated by three different transmitters which transmit during the burst periods shown in FIG. 5.

Referring now to FIG. 6, the output of gate 22 of transmitter 10 is illustrated for the transmitters 'a', 'b', and 'c', respectively. In the preferred embodiment, the R-C combination 16-18 of transmitter 'c' produces two pulses per 55 milliseconds, the R-C combination 16-18 of transmitter 'b' produces four pulses per 55 milliseconds, and the R-C combination 16-18 of transmitter 'a' transmits eight pulses per 55 milliseconds. A continuous pulse train (similar to that illustrated in FIG. 2) is supplied to gate 22 of each transmitter 10 on line 20. However, because frame generating means only provides a signal for the respective transmitters 10 corresponding to the burst spectrum of FIG. 5, the output of gate 22 only passes the pulse trains on lines 20 during those burst periods that the respective frame generator 31 generates a signal. The signal output by gate 22 of the transmitter 'a' is illustrated by pulse train 104 of FIG. 6. It is to be noted that two pulses are transmitted during burst period one, and two pulses are transmitted during burst period four. The signal output by gate 22 of transmitter 'b' is illustrated by pulse train 106 which transmits four pulses during burst period four and burst period six. The signal output by gate 22 of transmitter 'c' is illustrated by pulse train 108 in the bottom graph of FIG. 6. Here, eight pulses are transmitted in burst period four, and eight pulses are transmitted in burst period nine. It is significant that the pulse train 104 is high for only ten microseconds (i.e., two pulses each of a five microsecond duration) during each burst period, or 0.0000018% of each burst period. Similarly, pulse train 106 is high for only twenty microseconds, or 0.0000036% of each burst period, and pulse train 108 is high for only forty microseconds, or 0.0000073% of each burst period. Because the LEDs 26 only transmit energy during those times when a pulse train is high, battery consumption is minimized.

Because the output of gate 22 is coupled to the gate of the FET comprising switch means 24, pulse trains output by gate 22 of the transmitters 10 determine when the circuit containing LED's 26A and 26B closes, and hence, transmit light.

Note that waveforms for differing R-C combinations 16-18 describe LED 26 light emission of pulses of five microseconds in duration, but at different frequency rates and during different burst periods of each burst spectrum. Thus, no phase synchronization between the three signals can result.

Figure 7:
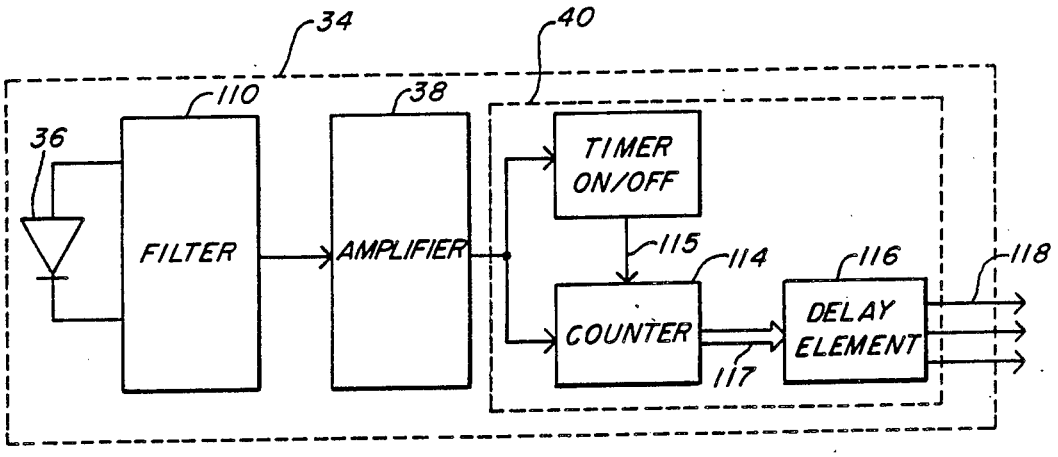
FIG. 7 illustrates a block diagram of the receiver forming a portion of the present invention.

Turning now to the block diagram of FIG. 7, there is illustrated a more detailed representation of the receiver 34 of FIG. 1. Receiver 34 detects the transmission of the signals generated by the light emitting diodes 26 of the portable transmitters 10. As mentioned previously, the LED's 26 of the transmitters 10 operate at intensity levels which saturate an area. Therefore, the receiver 34 need not be positioned to maintain a line of sight relationship with the transmitters 10 in order to receive the transmitted signals. Receiver 34 is, similar to the transmitter 10, preferably constructed of a printed circuit board utilizing surface mount technology. Detector 36 which comprises a portion of receiver 34 is positioned to sense infrared light transmitted by the transmitters 10. Each time in which sensor 36 detects infrared, the sensor 36 generates a signal which is supplied to filter 110. Filter 110, preferably comprised of both mechanical and electrical filter components, filters spurious infrared signals, such as those present in sun light and fluorescent light bulbs. A filtered signal is supplied to amplifier 38 which amplifies the filtered, sensed infrared signals. Amplifier 38, in the preferred embodiment, is comprised of a Mouser (TM) infrared amplifier 551-UPC13737HA. The Mouser amplifier is a preferred amplifier due to its high sensitivity characteristics, which, when coupled with the high intensity operation of the LED's 26, allows significantly better detection of transmitted infrared signals than prior art infrared systems. Amplifier 38 generates an amplified signal which is supplied to frequency detector 40. Frequency detector 40 includes both timer 112 and counter 114, and the amplified signal generated by amplifier 38 is supplied to both timer 112 and counter 114. Counter 114 counts pulses of the infrared signal generated by amplifier 38, and timer 112 determines the time intervals during which counter 114 counts pulses.

In the preferred embodiment of the present invention, the circuitry of timer 112 and counter 114 take advantage of the fact that transmitters 10 transmit pulse trains only during discrete burst periods of 55 milliseconds. In such an embodiment, timer 112 commences timing upon detection of a first input pulse supplied thereto by amplifier 38, and can generate a reset signal on line 115 after 55 milliseconds to reset counter 114. The number of pulses counted by counter 114 is supplied to delay element 116 in order to ensure that the detected signal counted by counter 114 is accurate. In the preferred embodiment of the present invention, delay element 116 outputs signals on line 118 if counter 114 detects the same pulse train over three burst spectra, i.e., three 550 millisecond periods. This approximately one and one half second time delay prevents inaccurate information, due to spurious signals, from being output on lines 118.

In the preferred embodiment in which transmitters 10 transmit pulse trains during burst periods as shown in FIGS. 5 and 6, counter 114 can count the pulses of pulse trains of various transmitters 10 which transmit the pulse trains during differing burst periods. Signals indicative of the existence of the various transmitters 10 may be supplied to delay element 116 on lines 117, and delay element 116 outputs signals on lines 118 indicating the detection of signals indicative of a particular transmitter 10.

The system of the present invention is particularly useful for maintaining a registry of classes of personnel within a facility such as a hospital. By maintaining an up-to-date registry wherein the locations of classes of personnel are continuously updated, hospital personnel may be more efficiently utilized. Additionally, accurate records may be maintained for future reference. In such a registry system, each member of each class of personnel carries a portable transmitter 10, and each room on a floor, or other given area, of a hospital has a receiver 34 positioned therewithin. Because a portable transmitter 10 may be constructed utilizing surface mount technology on a printed circuit board, the transmitter may be positioned within a plastic molded enclosure or casing as small as approximately 1.75 inches wide, 2.75 inches long, and ¼ inch in depth. The transmitters 10 may, for example, be formed as portions of name badges to be worn by the personnel.

Because the discharge of capacitor 28 allows the LED's 26A and 26B to operate at high intensity levels to saturate an area with infrared light, the diodes 26 need not be directed towards the infrared receiver in a line of sight method as was required with prior art infrared transmitter/receiver pairs. The receiver may be mounted, for example, horizontally on a wall in a room and detect a transmitted signal transmitted in any direction from any location in the room. It has been experimentally shown that a receiver constructed according to the teachings of the present invention can detect the existence of an indicating signal transmitted by a transmitter 10 of the present invention anywhere within an area of over 600 square feet.

In the preferred embodiment of the present invention, transmitters 10 are constructed to generate pulse trains of one of three frequencies, wherein the frequencies are defined by the R-C combinations 16-18. Each of the three RC combinations defines a class of personnel. Although the preferred embodiment is operative to locate members of three classes of personnel, greater or fewer numbers of classes of personnel may be tracked by other suitable RC combinations. For purposes of illustration, a first R-C combination 16-18 may designate a class consisting of hospital orderlies, a second RC combination 16-18 may designate a class of personnel consisting of nurses, and a third RC combination 16-18 may designate the class of personnel consisting of registered nurses. A member of a class of personnel is given a portable transmitter 10 constructed to not only generate a specific frequency pulse train, but also to transmit the pulse train during specific burst periods of a burst spectrum.

As noted hereinabove, because of the small size of the transmitter, the transmitter may be formed as a portion of a badge. The individual of a particular class wears the badge for visual identification purposes, while the transmitter, at the same time, transmits the pulse train during discrete burst periods. As described hereinabove, the pulse train generated by multivibrator oscillating means 12 is supplied to pulse shaping means 14 and frame generating means 31. As shown in FIG. 4, the modified frame pulse supplied to an input of gate 22 is output by the gate only when frame generating means 31 also inputs a signal to gate 22. The frequency of the pulse train defines the transmitter 10, and the signal generated by the frame generating means 31 prevents phase synchronization between signals generated by transmitters 10 carried by members of different classes of personnel by allowing the pulse train to be transmitted during only discrete periods of time.

Because the light emitting diodes 26 of the transmitters 10 are powered during those periods of time in which both capacitor 28 discharges and switch means 24 is closed, the LED's 26 transmit high intensity infrared, but only during five-microsecond intervals in which the pulses of the pulse trains are high. Battery life is thereby maximized. However, because of the high intensity transmission and the sensitivity of the amplifier 38, the receiver 34 positioned in each room in which the personnel are to be monitored may be positioned on a wall, for example, to provide a large monitoring area. Infrared detectors 36 detect the pulses generated by the portable transmitters 10, and generate signals responsive to those times in which infrared light is detected. The signals are filtered by filter 110 and supplied to amplifier 38 to amplify the detected pulse trains. The amplified pulse trains are supplied to frequency detector 40 which determines the frequencies of the detected pulse trains and generates signals indicative of such detections. Such an indication may be supplied to annunciating means 42, central recording means 44, and control means 46 whereat the registry of the location of the personnel may be maintained and continuously updated.

Preferably, filter 110 of receiver 34 contains a mechanical filter material covering the infrared detectors 36 to filter out light "noise" generated from, extraneous sources e.g., fluorescent light fixtures and sunlight, while allowing infrared light generated by diodes 26A and 26B to pass therethrough. Receiver 34 is also preferably contained in a shielded metal enclosure which is electrically coupled to the negative side of the power supply of the receiver to provide an electrical shield around the receiver.

A Wescom (TM) system is a system which may advantageously utilize the signals output by frequency detector 40 in order to maintain an up-to-date registry recording the locations of classes of hospital personnel. The Wescom (TM) is a microprocessor controlled system which contains what is referred to as nurse call master station. Such a nurse calling system is mounted remote from receiver 34 at a nurse control station to provide information received by the system from receiver 34 as well as to receive inputs regarding incoming calls received at the nurse station. The Wescom (TM) system further contains a CRT display and a modified telephone with keypad in order to answer and direct incoming calls. The microprocessor stores pertinent information about each patient that is displayed when each call is answered. The microprocessor based system functions as a control means 46 to make decisions based upon data received from the receivers 44. Control means 46 can be programmed in order to, for example, provide select paging of certain rooms through local annunciating means 48 where members of classes of personnel are detected. The Wescom system can also be coupled to other output devices such as sounding bells for making annunciations to alert hospital personnel of certain other calls on the system.

Because phase synchronization between signals generated by transmitters 10 carried by members of different classes of personnel is precluded due to the signals generated by frame generating means 31 of the respective transmitters 10, erroneous indications caused by simultaneous transmission of signals do not occur. Additionally, because the transmitted signal is a periodic signal, and not a uniquely coded binary information signal, prior art problems of incorrect identification of individuals or personnel is much less likely to occur. Still further, because of the constant monitoring of transmitted signals of portable transmitters 10 allowed by the increased reception range of the receiver, problems associated with entry/exit of personnel associated with prior art devices is avoided.

Figure 8:
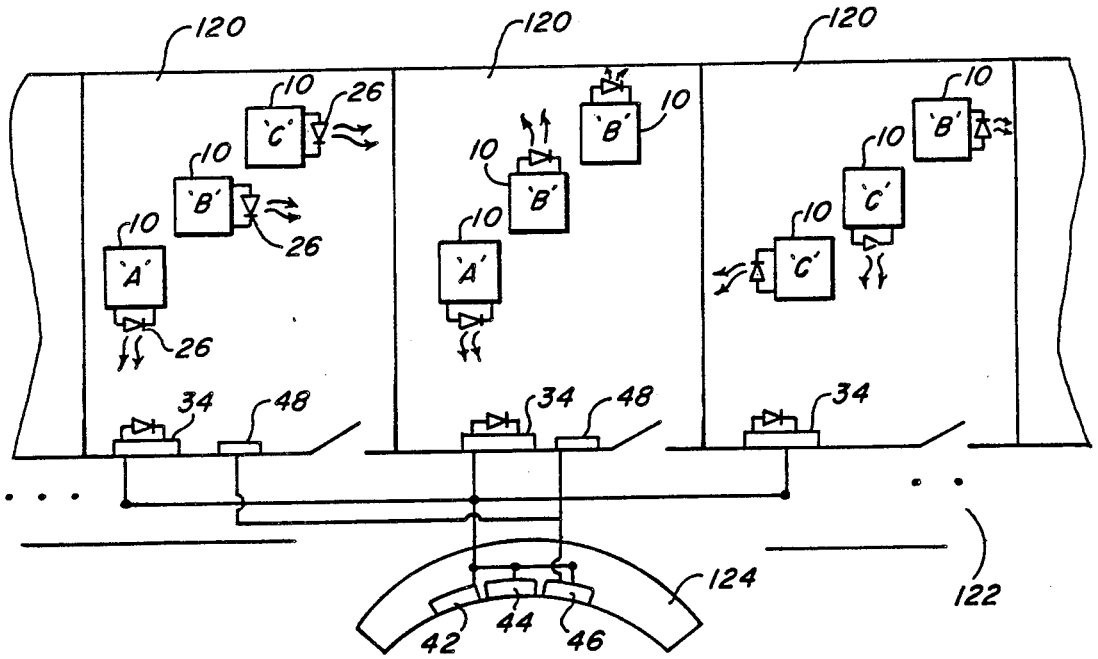
FIG. 8 is a partial block, partial schematic illustration of a preferred embodiment of the system of the present invention installed to maintain a registry of defined classes of personnel.

Turning now to FIG. 8, there is shown the system of the present invention installed in a location, such as a hospital wing. Several rooms 120 extend from a hallway 122. A receiver 34 is mounted on a wall in each room 120 to receive signals transmitted by a numerous transmitters 10 carried by personnel in each of the rooms. Each receiver is coupled to a remote station 124, such as a nurse's station whereat annunciating means 42, recording means 44, and control means 46 (such as the aforementioned Wescom (TM) system) are located. Each time in which a receiver 34 detects a signal transmitted by a transmitter 10, a signal responsive to such detection is supplied to the various devices at the remote station 124. A local annunciating means 48 may further be positioned in the rooms 120 to make local annunciations responsive to signals generated by control means 46. The transmitters 10 are positioned in the rooms 120 to illustrate that the LEDs 26 of the transmitter 10 need not be positioned in a line of sight relationship with receivers 34 to allow detection of the transmitted signals, but rather, may be positioned in any relative orientation.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A personnel locator system installable on a premises comprising at least one portable communication unit adapted to be carried by an individual and monitored at appropriate locations about the premises, said system including:

means for generating pulses defining a pulse train wherein said pulses occur at a predetermined frequency;

means for determining discrete time intervals defining burst periods, wherein groups of said burst periods define a burst spectrum;

infrared means for transmitting said pulse train generated by said means for generating pulses during selected ones of said burst periods; and means responsive to said pulse train transmitted during said selected ones of the burst periods for producing a signal responsive thereto.

2. The system of claim 1 wherein said means for generating pulses includes a multivibrator means for generating a pulse train having square wave pulses occurring at said predetermined frequencies.

3. The system of claim 2 further including a pulse shaping means coupled to receive said pulse train generated by the multivibrator means for shaping the pulses of the pulse train into pulses having precisely defined pulse widths.

4. The system of claim 1 wherein said means for determining defines ten burst periods per burst spectrum.

5. The system of claim 4 wherein said means for transmitting transmits said pulse train for two burst periods during each burst spectrum.

6. The system of claim 5 wherein the pulse widths of the pulse train shaped by the pulse shaping means are of five microseconds for minimizing power consumption.

7. The system of claim 6 wherein each burst period is of fifty-five milliseconds in duration

8. The system of claim 7 wherein eight or fewer of the pulses shaped by the pulse shaping means are transmitted during one burst period.

9. The system of claim 4 including a plurality of said portable communication units wherein said plurality of portable communication units are grouped into classes, said classes being defined by the predetermined frequencies of the pulse train generated by the means for generating pulses of each of the plurality of portable communication units.

10. The system of claim 9 wherein said means for transmitting of each portable communication unit transmits said pulse train for two burst periods during each burst spectrum, said burst periods being selected such that the communication units of different ones of said classes transmit said pulse trains for nonidentical burst periods.

11. The system of claim 9 wherein said means responsive to said pulse train includes a plurality of discrete receivers, each of said discrete receivers defining a separate defined reception range about a premises, wherein reception of said pulse train by a receiver indicates the presence of a portable communication unit within the location defined by the reception range thereof, and wherein the predetermined frequency of the pulse train identifies the class of portable communication unit.

12. The system of claim 1 wherein said means for transmitting said periodic signal includes infrared light emitters.

13. The system of claim 12 further including means for powering said infrared light emitters, said means for powering including a battery connected in parallel with a capacitor.

14. The system of claim 13 wherein said battery generates a current for charging the capacitor and wherein discharge of the capacitor powers the infrared emitters such that the infrared emitters operate at high intensity levels during said discharge.

15. The system of claim 12 wherein said means responsive to said pulse train includes infrared detectors for detecting infrared emitted by said infrared emitters.

16. The system of claim 15 wherein said means responsive to said pulse train generates a signal in response to those times in which transmission of said pulse train is detected.

17. The system of claim 16 further including a central recording means coupled to receive said signal generated by the means responsive to said pulse train for recording those times in which said pulse train is detected.

18. The system of claim 16 further including an annunciating means coupled to receive said signal generated by the means responsive to said pulse train for annunciating those times in which said pulse train is detected.

19. The system of claim 16 further including a control means coupled to receive said signal generated by the means responsive to said pulse train for providing control functions responsive to those times in which transmission of said pulse train is detected.

20. A registry system for maintaining a registry of the locations of defined classes of personnel, said registry system including:

a portable transmitter carried by each of the members of each of the defined classes of personnel, each portable transmitter including means for generating pulses defining a pulse train, wherein said pulses occur at a predetermined frequency, said predetermined frequency identifying the portable transmitter carried by the members of each of the classes; means for determining discrete time intervals defining burst periods wherein groups of said burst periods form a burst spectrum; and a transmitting means for transmitting said pulse train during selected ones of said burst periods wherein the predetermined frequency defining the pulse train generated by each portable transmitter carried by members of each of the defined classes of personnel has values for differentiating between said classes of personnel;

receiving means comprised of a plurality of spaced-apart discrete receivers, each of said discrete receivers having a defined reception range, for receiving said pulse trains generated by the portable transmitters when any of said transmitters is within the defined reception range of individual ones of the discrete receivers; and central recording means coupled to the receiving means for recording those times in which a particular discrete receiver receives pulse train generated by a portable transmitter to thereby register the location of a member of a class of personnel carrying the transmitter.

21. The registry system of claim 20 wherein said transmitting means of the portable transmitter includes infrared emitters.

22. The registry system of claim 21 wherein said spaced-apart discrete receivers comprising said receiving means include infrared detectors for detecting infrared generated by the infrared emitters.

23. The registry system of claim 21 further including a power means comprised of a battery and a capacitor connected in a parallel connection.

24. The registry system of claim 23 wherein said battery generates a current for charging a capacitor and wherein discharge of the capacitor powers the infrared emitters such that the infrared emitters operate at high energy levels during such discharge.

25. The registry system of claim 20 wherein said means for generating pulses includes a multivibrator means for generating square wave pulse trains of desired frequencies and pulse shaping means coupled to receive said pulse trains for shaping individual pulses of the pulse trains into pulses of precisely defined pulse widths 26. A personnel locator system installable on a premises comprising at least one portable communication unit adapted to be carried by an individual and monitored at appropriate locations about the premises, said system including:

multivibrator means for generating a pulse train having square wave pulses occurring at predetermined frequencies;

pulse shaping means coupled to receive said pulse train generated by the multivibrator means for shaping the pulses of the pulse train into pulses having pulse widths of five microseconds;

means for determining discrete time intervals defining burst periods of fifty-five milliseconds in duration, wherein groups of ten burst periods define a burst spectrum;

infrared emitters for transmitting said pulses of the pulse train during two of said burst periods of each burst spectrum;

means for powering said infrared emitters, said means for powering including a battery connected in parallel with a capacitor, wherein said battery generates a current for charging the capacitor, and wherein discharge of the capacitor powers the infrared emitters such that the infrared emitters operate at high intensity levels during said discharge;

infrared detectors for detecting infrared emitted by the infrared emitters;

means for generating a signal in response to those times in which said infrared detectors detect transmission of the pulse train; and annunciating means coupled to receive said signal generated by said means for annunciating those times in which said pulse train is detected.

27. The system of claim 26 further including a central recording means coupled to receive said signal generated by the means for generating for recording those times in which said pulse train is detected.

28. The system of claim 27 further including a control means coupled to receive said signal generated by the means for generating for providing control functions responsive to those times in which transmission of said pulse train is detected.

29. The system of claim 28 including a plurality of said portable communication units wherein said plurality of portable communication units are grouped into classes, said classes being defined by the predetermined frequencies of the pulse train generated by the multivibrator means of each of the plurality of portable communication units.

30. The system of claim 29 wherein said infrared emitters of each portable communication unit transmit said pulse train for said two burst periods during each burst spectrum, wherein said two burst periods are selected such that the communication units of different ones of said classes transmit said pulse trains for non-identical burst periods.

31. The system of claim 30 wherein said infrared detectors are coupled to a plurality of discrete receivers, each of said discrete receivers defining a separate defined reception range about a premises, wherein reception of said pulse train by an infrared detector coupled to a receiver indicates the presence of a portable communication unit within the location defined by the reception range thereof, and wherein the predetermined frequency of the pulse train identifies the class of portable communication unit.

32. An infrared transmitter including:

means for generating pulses defining a pulse train wherein said pulses occur at a predetermined frequency;

means for determining discrete time intervals defining burst periods, wherein groups of said burst periods define a burst spectrum; and infrared means for transmitting said pulse train generated by said means for generating pulses during selected ones of said burst periods.

* * * * *